US007255573B2

(12) United States Patent
He et al.

(10) Patent No.: US 7,255,573 B2
(45) Date of Patent: Aug. 14, 2007

(54) DATA SIGNAL INTERCONNECTION WITH REDUCED CROSSTALK

(75) Inventors: Jiangqi He, Gilbert, AZ (US); BaoShu Xu, Shanghai (CH); Xiang Yin Zeng, Shanghai (CH)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/324,040

(22) Filed: Dec. 30, 2005

(65) Prior Publication Data

US 2007/0155195 A1 Jul. 5, 2007

(51) Int. Cl.
*H01R 12/00* (2006.01)

(52) U.S. Cl. ..... 439/66; 439/941

(58) Field of Classification Search ..... 439/66, 439/71, 72, 74, 941
See application file for complete search history.

(56) References Cited

U.S. PATENT DOCUMENTS

| | | | | |
|---|---|---|---|---|
| 4,427,247 | A * | 1/1984 | Petersen | 439/68 |
| 4,652,973 | A * | 3/1987 | Baker et al. | 361/739 |
| 4,855,719 | A * | 8/1989 | Posey | 340/568.3 |
| 6,017,247 | A * | 1/2000 | Gwiazdowski | 439/676 |
| 6,449,165 | B1 * | 9/2002 | Lee et al. | 361/760 |

* cited by examiner

*Primary Examiner*—Hien Vu
(74) *Attorney, Agent, or Firm*—Blakely, Sokoloff, Taylor & Zafman LLP

(57) ABSTRACT

Data signal interconnections are described that offer reduced cross talk particularly with high speed differential signaling. In one example, the invention includes a plurality of interconnects to carry data signals between a first component and a second component, the plurality of interconnects including a first set of interconnects oriented in a first direction and a second set of interconnects oriented in a second direction, different from the first direction.

11 Claims, 4 Drawing Sheets

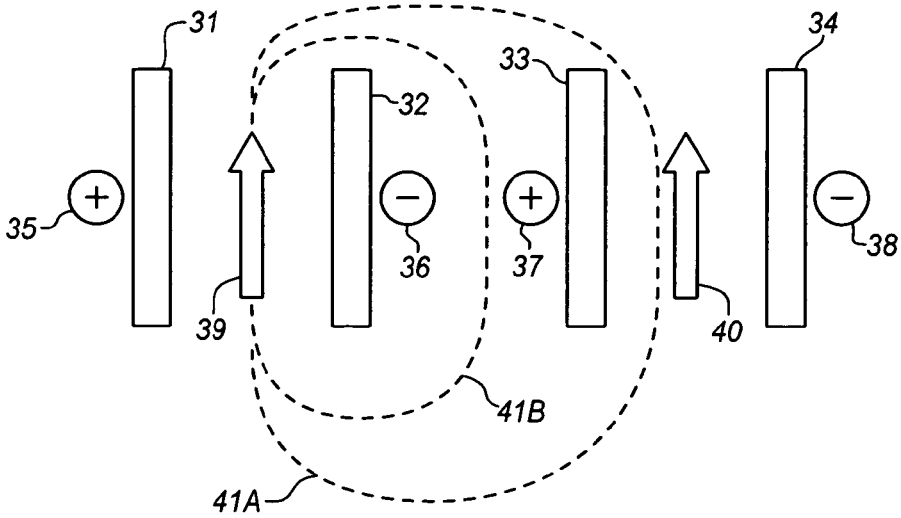
FIG. 3
FIG. 4
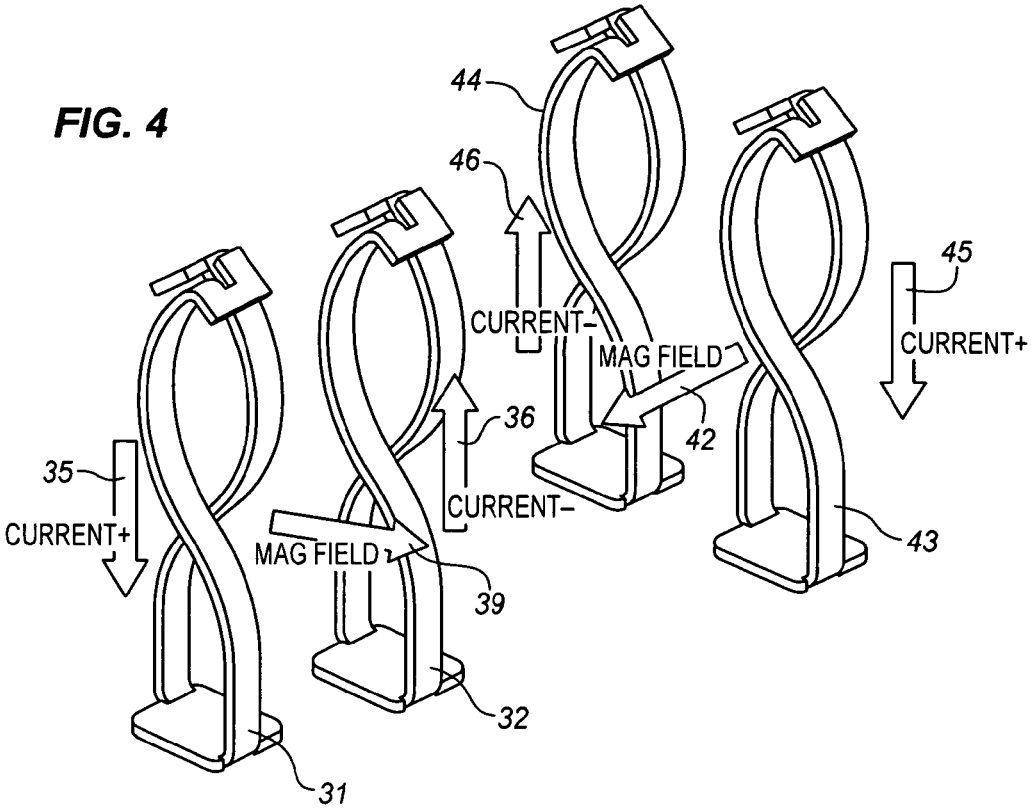

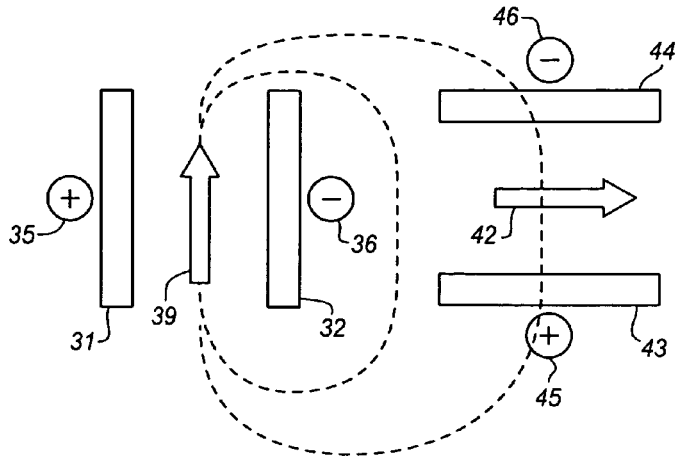
FIG. 5
FIG. 6A
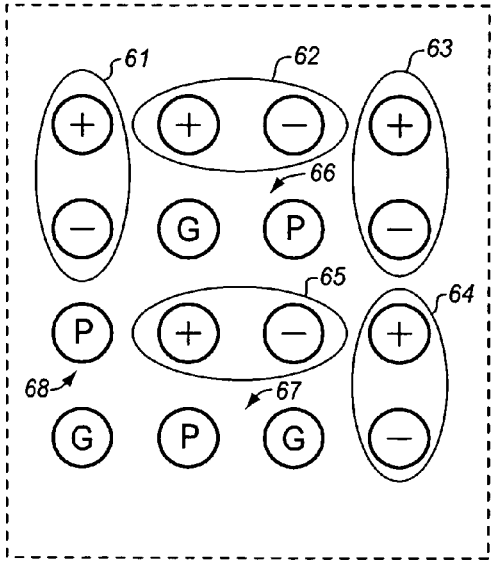
FIG. 6B
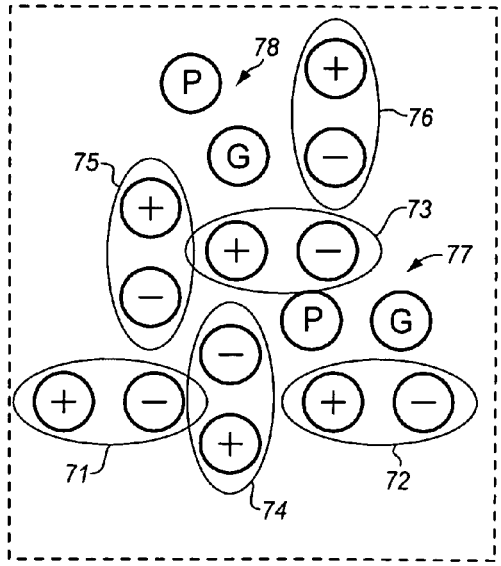

DATA SIGNAL INTERCONNECTION WITH REDUCED CROSSTALK

FIELD

The present description relates to connections used to provide high speed communications between microelectronic devices and, in particular, to interconnects configured to reduce cross-talk between the interconnects.

BACKGROUND

Electronic equipment, such as computers and communication devices often use a processor that is mounted in a socket. The socket is, in turn, mounted on a motherboard, such as a printed circuit board that connects the processor to other components. Several other devices on the motherboard may also use a socket, depending on the particular design. The socket allows the processor to be installed safely on the motherboard and allows the processor to be replaced with a faster or different model or as a repair. In a typical connection, the processor has a large number of pins or contact pads that electrically connect to a corresponding set of interconnects in the form of pins or contact pads on the socket. Often the interconnects on the socket are spring loaded or designed to have some resilience. The springiness allows all of the interconnects to make a clean connection even if the processor pins are not all perfectly aligned or if the processor's package is not perfectly flat.

The high speed of the data that is routed through many of the interconnects on the socket require interconnects that have very clean electrical properties. With higher speed data, the electrical requirements include impedance matching, low insertion loss and low cross-talk. These and other electrical effects can interfere with the data, making it unusable by the processor or by a device with which the processor is trying to communicate. However, in recent years, signal speed through the socket interconnect has doubled almost every two years. The speed increases place increasingly difficult requirements on the interconnects. With higher frequency data signals, the package and socket vertical interconnect may limit the speed at which data can be communicated.

Two reasons that vertical interconnects degrade the I/O (input/output) performance of a computer system are impedance mismatch between the processor and the socket and cross-talk between the socket pins. The cross-talk can be generated by inductive coupling between pins and capacitive coupling between pins. Inductive coupling is caused by the mutual inductance between two adjacent conductors, in this case the interconnects or pins. Capacitive coupling is due to the mutual capacitance between the two conductors.

While the mutual inductance and mutual capacitance between pins is not frequency dependent, the cross talk caused by the mutual capacitance and mutual inductance can be reduced by reducing the frequency of the signals. However, reducing the data signal frequency slows the data rates that the processor can support. They can also be reduced by moving the connectors farther apart, but many processors already use all of the available space for connectors. They can also be reduced by reducing the height of the socket pins, but this causes mechanical problems that limit the connections.

BRIEF DESCRIPTION OF THE DRAWINGS

Embodiments of the present invention will be understood more fully from the detailed description given below and from the accompanying drawings of various embodiments of the invention. The drawings, however, should not be taken to be limiting, but are for explanation and understanding only.

FIG. 3 is a top plan view of the socket interconnects of FIG. 2;

FIG. 4 is a perspective drawing of two pairs of vertical socket interconnects according to an embodiment of the present invention;

FIG. 5 is a top plan view of the socket interconnects of FIG. 4;

FIG. 6A is a diagram of a portion of a socket pin bed in a rectangular configuration according to an embodiment of the present invention;

FIG. 6B is a diagram of a portion of a socket pin bed in a circular configuration according to an embodiment of the present invention.

DETAILED DESCRIPTION

Embodiments of the present invention provide a socket pin pattern that can eliminate socket pin inductive cross-talk, and also reduce capacitive cross-talk. This allows for new generations of high speed I/O to be easily supported, without any significant impact on the cost or the design of the socket or the microprocessor.

In some embodiments of the invention, pairs of parallel socket connections that carry differential signals are positioned to generate a magnetic field orthogonal to neighboring differential signal pairs. With the magnetic field generated by the pair of pins perpendicular to the magnetic field generated by the next pair, inductive coupling between the two pairs may be eliminated. The area of each pair of pins that faces another pair of pins may also be reduced, reducing the capacitive coupling between the two pairs.

Figure 1:
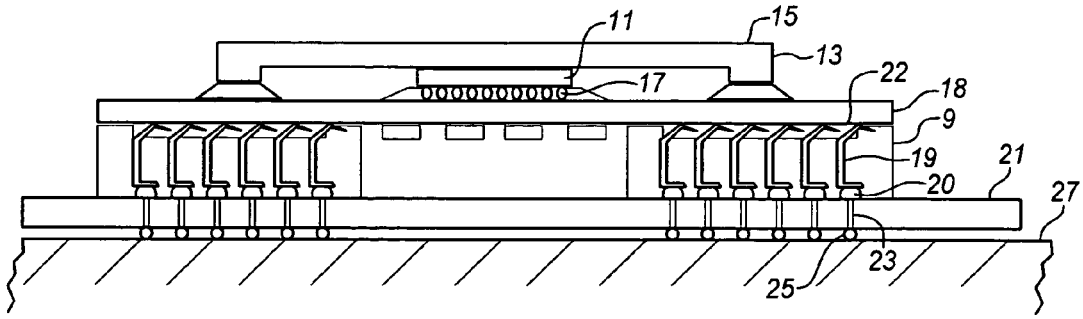
FIG. 1 is a cross-sectional diagram of a packaged chip, connected to a socket and a motherboard suitable for an embodiment of the present invention.

FIG. 1 shows a cross-sectional diagram of an example of a processor or CPU (central processing unit) to motherboard connection. In FIG. 1, a socket 9 is connected to a processor 11 that is carried in a chip package 13. The processor is electrically coupled to the package through an array of, for example, solder bumps 17 that connect external pins of the processor to a bottom plate 18 of the package. The bottom plate of the package has an array of lands or contact pads 22 to provide an electrical contact with the socket. The top of the package may be a heat spreader bar 15 that is in thermal contact with the processor. The heat spreader bar may carry fins, fans, heat pipes, liquid coolers or any other device depending on the particular application. The package of FIG. 1 is provided as an example and embodiments of the invention may be applied to many different types and configurations of packages as well as to systems that do not use a package.

The socket 9 includes an array of vertical interconnects 19 that make an electrical connection with the array of pads 22 on the package. The interconnects come in a wide range of different types and forms. In the example of FIG. 1, the interconnects have a curved arc or bend at the top surface that acts as a resilient spring. This top bend makes a resilient connection with the package. Copper may be used for this interconnect, however, other resilient conductive materials may also be used. The interconnects are connected to the bottom plate 21 of the socket using solder balls 20. The solder balls are coupled through vias 23 to another set of solder balls 25 on the bottom of the socket. The socket is then soldered to the printed circuit board 27 (PCB, also referred to as a printed wiring board or PWB). In the example of a microprocessor, the PCB may be a computer motherboard. The PCB may have several layers of conductive paths, traces, or planes (not shown) to couple each of the pins of the processor to other components (not shown) for power, control, signaling, data, clocking, and other functions.

The vertical interconnects 19 of the socket 9 are relatively large and numerous. These large interconnects make it much easier to install and remove the processor package. However, the size and poor power and ground referencing do cause some difficulties.

The cross-talk that interferes with signal communications has at least two significant components, inductive coupling and capacitive coupling. The inductive coupling is caused by the mutual inductance between two adjacent conductors, in this case the interconnects. With differential signaling, a signal current will be running in adjacent interconnects in opposite directions.

Figure 2:
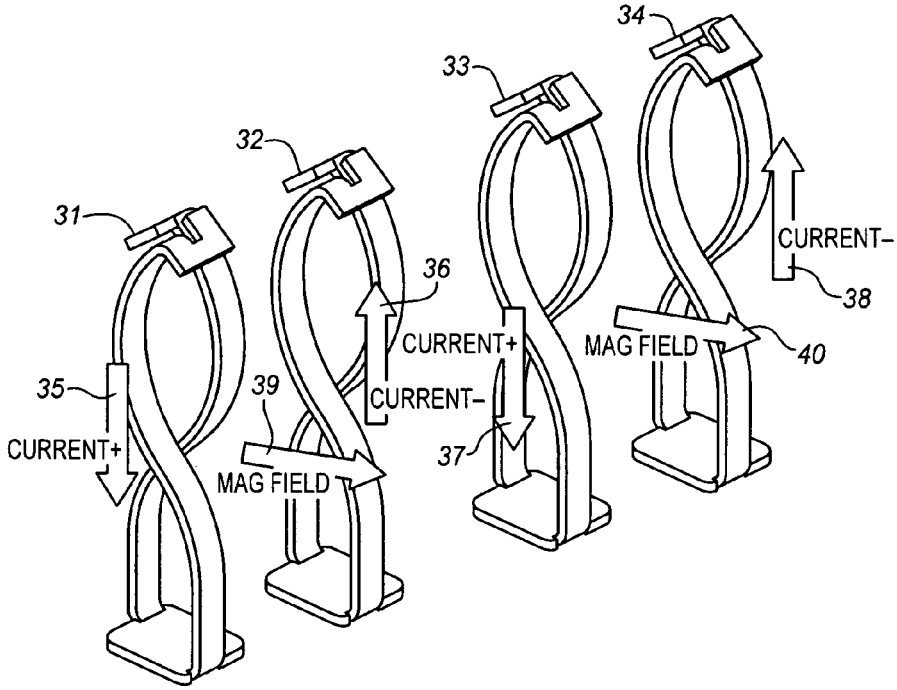
FIG. 2 is a perspective drawing of two pairs of vertical socket interconnects in a conventional configuration.

FIG. 2 shows two pairs of vertical interconnects. The first pair is made up of an output connector 31 and an input connector 32. As shown by an arrow 35, signal current flows down the page through the output connector representing current flow from the processor to the motherboard. In the other interconnect 32 of the pair, signal current flows up the page, as shown by an arrow 36, representing signals from the motherboard into the processor. The signal may correspond to digital or serial data, control, address, clocking, power or other types of signals.

A magnetic field is generated by the current flowing in opposite directions in the two neighboring pins. The two interconnects behave like a coil and the current generates a magnetic field in a direction as shown by an arrow 39. This magnetic field stores energy from the current and opposes changes in the current. The magnetic field also generates current in neighboring conductors. In other words, the first magnetic field interacts with magnetic fields generated by any nearby interconnect pairs. In FIG. 3, another interconnect pair is shown with an output connector 33 having a downward current flow 37 and an input connector 34 having an upward current flow 38. The connectors are all aligned in a row oriented in the same direction and with input connectors alternating with output connectors, so the second pair also generates a magnetic field indicated by an arrow 40 in the same direction.

The magnetic fields, flowing in the same direction couple together and interact with each other. Changes in the signal current of one pair, changes its magnetic field. This change in the magnetic field affects the magnetic field of the other pair. The changed magnetic field induces a change in the current flowing through the second pair of interconnects. The same phenomenon occurs to the current of the first pair when the current in the second pair changes. The magnetic fields couple the two pairs of interconnects together, generating cross-talk. A typical socket has hundreds of interconnects all placed close together and generating magnetic fields that interact through their neighbors and, in turn, through their neighbors across the whole socket. The crosstalk caused by the mutual inductance interaction increases with frequency as does the impact that crosstalk can have on signal integrity (the ability of a circuit to accurately receive a signal).

The same configuration of four socket pins is shown in a top view in the diagram of FIG. 3. FIG. 3 shows how the direction of current flow alternates from one pin to the next and how the magnetic fields of the two pairs are aligned in the vertical direction. FIG. 3 also shows magnetic field lines 41A and 41B. The field lines complete a circuit through the center of the loop and may interact with a similar magnetic field from the neighboring pair of connectors.

According to one embodiment of the invention, the inductive coupling described with respect to FIGS. 2 and 3 may be reduced or even eliminated by making the pair-to-pair magnetic fields orthogonal to each other. Orthogonal magnetic fields have no inductive coupling. In other words, the coupling is zero because when the area of the neighboring loop and the magnetic field are perpendicular, their cross product is zero.

Orthogonal pin orientations are shown in FIG. 4. In FIG. 4, the same first pair of interconnects 31, 32 with the same current flow 35, 36 generates the same magnetic field 39 as described above with respect to FIG. 2. The neighboring pair, however, has been rotated by 90 degrees or a quarter circle. The rotation is done so that the magnetic field 42, generated by the current flow 45, 46 through the two interconnects 43, 44 is orthogonal to the magnetic field 39 generated by the first pair. In the example of FIG. 4, the second pair is rotated counter-clockwise by exactly 90 degrees. The same results, however, may be obtained by rotating the second pair clockwise by the same amount.

The top view diagram of FIG. 5 shows clearly that the two magnetic field vectors are orthogonal to each other and that the second interconnect pair has been rotated. Even though the magnetic field lines 41A and 41B cross through corresponding magnetic field lines (not shown) of the second pair, there is no cross coupling due to the orthogonality.

While the two magnetic fields are shown as having very specific direction and orientation with respect to the interconnects, in any implementation, the relationship of the magnetic fields to the interconnects may depend on the particular physical design of the interconnect. In some implementations, it may not be possible to ensure that the magnetic fields are perfectly orthogonal. However, even if the magnetic fields are spread over a range of directions, rotating the magnetic fields to be closer to orthogonal may reduce the amount of cross-talk. Similarly, it is not necessary to rotate the second pair a full 90 degrees, a partial rotation will reduce the cross-talk. The amount of rotation may be selected depending on the physical and electrical characteristic of the socket connections. The current, voltage and frequency of the signals changes the amount of cross-talk as does the shape, size and proximity of the interconnects.

There are a wide range of socket interconnects in use in different sockets for different processors as well as for other types of microelectronic chips. Socket pins are redesigned for new applications to meet different performance requirements for mechanical strength, resilience, and size as well as for reliability and electrical conductivity. In the examples of FIGS. 3 and 4, the socket interconnects have a figure eight shape. Such an interconnect has many mechanical benefits, but its size, orientation and double loop shape tend to increase cross-talk effects. For such an interconnect, the orthogonal approach shown in FIG. 4 is particularly useful. However, embodiments of the invention may be applied to other sizes and shapes of interconnects.

Cross-talk may also be created between the two pairs of socket pins by capacitive coupling. Capacitive coupling is caused by a mutual capacitance between any two conductors. There are at least three different ways to reduce a mutual capacitance. These include reducing the effective surface area between the two conductors, increasing the distance between the two conductors, and reducing the dielectric constant of the material between the two conductors. The distance between the conductors is limited by the size of the socket and the number of pins, among other factors. The material between the pins is typically air which already has a very low dielectric constant. Rotating the pin pairs, as shown in FIGS. 4 and 5, however, has a significant impact on the effective surface area between the two conductors.

Comparing FIGS. 3 and 5, the top view of the socket pins may be compared. In FIG. 3, the two closest pins 32, 33 each have an elongated surface and these two surfaces are aligned parallel to each other. In the top view, these resemble the two parallel plates of a traditional capacitor with air as the dielectric between them. The other two pins 31, 34 bolster the capacitive effect but to a lesser degree than the adjacent pins. With the rotation of FIG. 5, the surfaces are now perpendicular. Since the area of the second pair that faces the area of the first pair is reduced, the mutual capacitance will be reduced as well. This further reduces the cross-talk. The particular amount of rotation and the orientation of the pins may be modified to suit other implementations and other pin designs.

FIG. 6A shows an example of how a larger number of socket pins may be arranged on a socket. Since a socket my have hundreds of pins, FIG. 6A shows only a small number (16) of the pins that may be used in any particular implementation. FIG. 6A shows a rectangular grid of 16 evenly spaced pins may be repeated until the total number of pins desired, perhaps hundreds, is obtained.

In FIG. 6A, five pairs of interconnects 61, 62, 63, 64, 65 are each arranged either horizontally or vertically. The two horizontal pairs 62, 65 have a positive pin on the left and a negative pin on the right and are separated by a pair 66 of DC (direct current) power pins with ground on the left and power on the right. The orientation of the power pins is reversed in a second pair of power pins 67 below the lower data signal pin pair. The orientation of the power pins may be reversed as the DC power does not contribute to crosstalk. However, the power pins do provide a spacer between nearby data signal pins. The assignment of the power pin polarities may be made also based on other considerations not related to crosstalk. In addition, the plus and minus orientation of the data signal pins may be reversed. As shown in the diagram, the two horizontal pairs of pins are arranged with the same polarization, this is beneficial for the vertical pairs.

The three vertical pairs 61, 63, 64 of data signal pins are all arranged with positive upper pins and negative lower pins. They are placed on either side of the two horizontal pairs except that a pair of power pins 68 is placed on the left side of the bottom horizontal pair 65. This provides a spacer between the bottom horizontal pair and the next vertical pair as the pattern is repeated. Note that as the pattern is repeated, the upper vertical pairs will be placed next to other vertical pairs but because of the spacing and different orientation of the remaining pairs, crosstalk will be significantly reduced as compared to conventional configurations.

FIG. 6B shows an example of a configuration that may be adapted for circular and other types of connection configurations. In FIG. 6B, three horizontal pairs 71, 72, 73 of data signal pins are arranged with positive poles on the right and negative poles on the left. The lower two pairs 71, 72 are in a row and a vertical pair 74 is positioned between them with its negative pole on the top and the positive pole on the bottom. The vertical pair is positioned so that the horizontal pairs 71, 72 are aligned with its midpoint between the two poles of the vertical pair.

The third horizontal pair 73 is positioned directly above the first vertical pair 74 so that its left side positive pole is directly above the negative pole of the vertical pair. Similarly, the left side positive pole is near the midpoint of another vertical pair 75 to its left. This second vertical pair has its positive pole above its negative pole. The left-side negative pole of the third horizontal pair 73 is directly below a third vertical pair 76. The third vertical pair has its positive pole above its negative pole so that the negative pole is directly above the negative pole of the horizontal pair.

Power pins may again be used as spacers between the data signal pins. In FIG. 6B, a first pair of power pins 77 is positioned between the right side horizontal pair 72 and the upper horizontal pair 73. A second pair of power pins 78 is positioned above the upper horizontal pair 73 between its neighboring vertical pairs 75, 76. As with FIG. 6A, the configuration of FIG. 6B may be repeated multiple times to create a pattern of hundreds of pins. While some pairs of adjacent pins may be aligned in orientation, many other adjacent pairs will not be. Many pairs of pins will also be spaced apart from other pairs by power pins.

The particular orientations and positions of the various pairs of pins in FIG. 6A and FIG. 6B are provided as examples, however any one of more of the pairs may be moved or reoriented to suit a particular application. The number and position of power pins may be increased or reduced or the power pins may be removed completely from the illustrated configurations. In addition, while the power pins are also shown as pairs with power and ground near each other, power and ground pins may be separated. Either power or ground or both may be provided separate from the illustrated configurations of pins.

Figure 7:
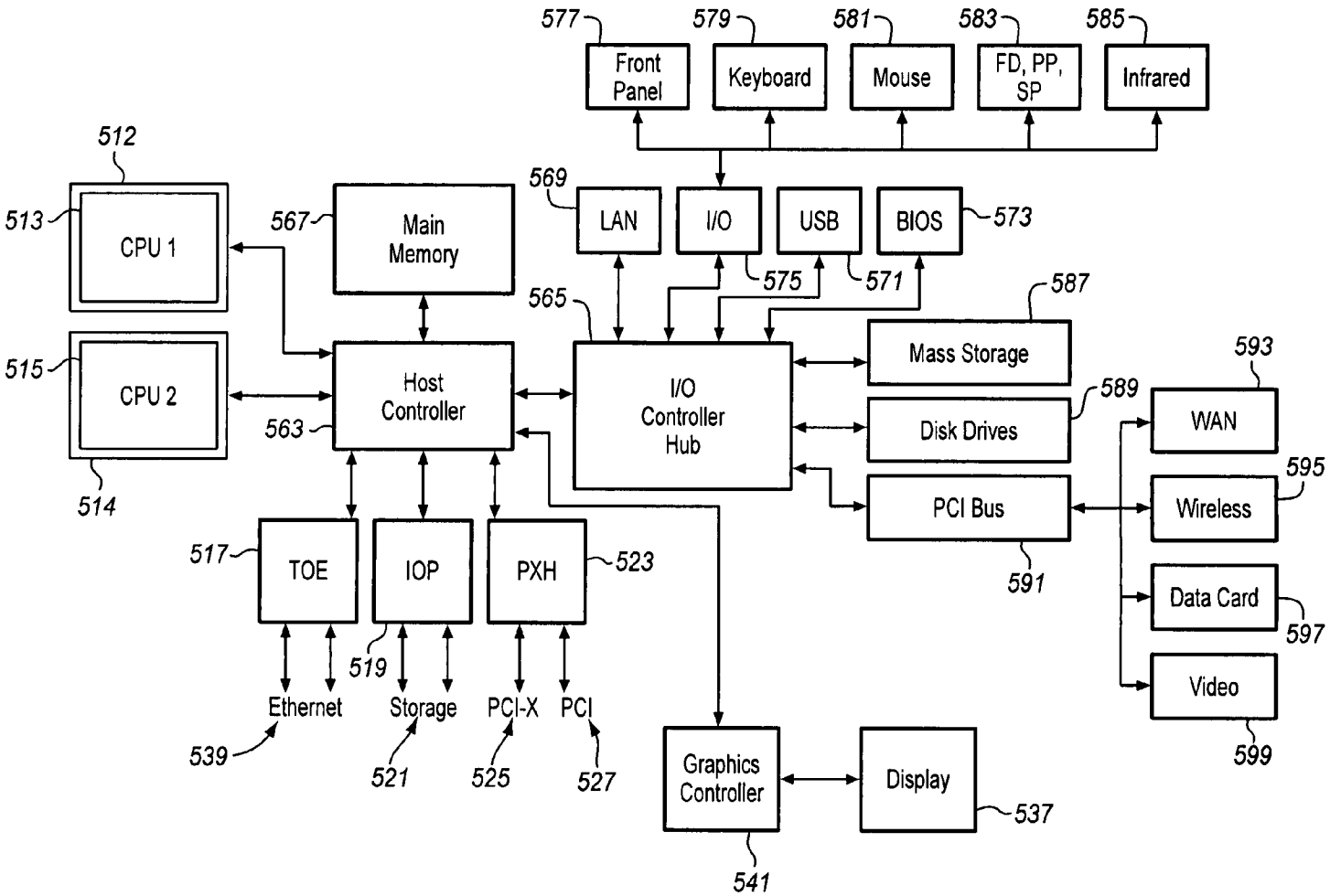
FIG. 7 is an example of a computer system suitable for incorporating embodiments of the present invention.

FIG. 7 shows an example of computer system that uses processors coupled to sockets using interconnects such as those described above. In the example of FIG. 7, the MCH (memory controller hub) 563 has a pair of FSBs (front side bus) each coupled to a socket 512, 514 that holds a CPU or processor core 513, 515. More or less than two processor cores and FSBs may be used. Any number of different CPUs and chipsets may be used. The MCH receives and fulfills read, write and fetch instructions from the processor cores over the FSBs. The MCH also has an interface to system memory 567, such as DIMMs (Dual In-line Memory Modules) in which instructions and data may be stored, and an interface to the ICH (input/output controller hub) 565.

The MCH also has an interface, such as a PCI (peripheral component interconnect) Express, or AGP (accelerated graphics port) interface to couple with a graphics controller 541 which, in turn, provides graphics and possible audio to a display 537. The PCI Express interface may also be used to couple to other high speed devices. In the example of FIG. 5, six x4 PCI Express lanes are shown. Two lanes connect to a TCP/IP (Transmission Control Protocol/Internet Protocol) Offload Engine 517 which may connect to network or to TCP/IP devices such as Gigabit Ethernet controllers 539. Two lanes connect to an I/O Processor node 519 which can support storage devices 521 using SCSI (Small Computer System Interface), RAID (Redundant Array of Independent Disks) or other interfaces. Two more lanes connect to a PCI translator hub 523 which may support interfaces to connect PCI-X 525 and PCI 527 devices. The PCI Express interface may support more or fewer devices than are shown here. In addition, while PCI Express and AGP are described, the MCH may be adapted to support other protocols and interfaces instead of, or in addition to those described.

The ICH 565 offers possible connectivity to a wide range of different devices. Well-established conventions and protocols may be used for these connections. The connections may include a LAN (Local Area Network) port 569, a USB hub 571, and a local BIOS (Basic Input/Output System) flash memory 573. A SIO (Super Input/Output) port 575 may provide connectivity for a front panel 577 with buttons and a display, a keyboard 579, a mouse 581, and infrared devices 585, such as IR blasters or remote control sensors. The I/O port may also support floppy disk, parallel port, and serial port connections 583. Alternatively, any one or more of these devices may be supported from a USB, PCI or any other type of bus or interconnect.

The ICH may also provide an Infiniband, Fiber Channel, iSCSI, IDE (Integrated Device Electronics) bus or SATA (serial advanced technology attachment) bus for connections to disk drives 587, 589 or other large memory devices. The mass storage may include hard disk drives and optical drives. So, for example, software programs, parameters or user data, may be stored on a hard disk drive or other drive. A PCI (Peripheral Component Interconnect) bus 591 is coupled to the ICH and allows a wide range of devices and ports to be coupled to the ICH. The examples in FIG. 5 include a WAN (Wide Area Network) port 593, a Wireless port 595, a data card connector 597, and a video adapter card 599. There are many more devices available for connection to a PCI port and many more possible functions. The PCI devices may allow for connections to local equipment, or nearby computers. They may also allow for connection to various peripherals, such as printers, scanners, recorders, displays and more. They may also allow for wired or wireless connections to more remote equipment or any of a number of different interfaces.

The particular nature of any attached devices may be adapted to the intended use of the device. Any one or more of the devices, buses, or interconnects may be eliminated from this system and others may be added. For example, video may be provided on the PCI bus, on an AGP bus, through the PCI Express bus or through an integrated graphics portion of the host controller.

The electrical interconnects described above may be provided for any of the interfaces devices and components of FIG. 7 for several interconnects are placed in close proximity. The electrical interconnects may be particularly well suited for any devices that may be coupled to a PCB using a socket. This may include memory, graphics controllers and various I/O devices.

The shape, design, and configuration of the electrical interconnects described above, may be modified or changed to adapt to different implementations. The shape, configuration, proximity and orientation of the interconnects will vary from implementation to implementation depending upon numerous factors, such as price constraints, performance requirements, technological improvements, or other circumstances. Embodiments of the invention may also be applied to other types of systems that use different types of chips and sockets than those shown in the Figures. While embodiments of the invention have been described in the context of a processor package coupled to a socket, embodiments of the invention may also be applied to a wide range of other devices.

In the description above, for purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form.

Many of the structures and configurations are described in their most basic form, but changes may be made to any of the components and configurations and elements may be added or subtracted from any of the described apparatus without departing from the basic scope of the present invention. It will be apparent to those skilled in the art that many further modifications and adaptations may be made. The particular embodiments are not provided to limit the invention but to illustrate it. The scope of the present invention is not to be determined by the specific examples provided above but only by the claims below.

What is claimed is:

1. An apparatus comprising:

a plurality of interconnects to carry data signals between a first component and a second component, the plurality of interconnects including a first set of interconnects oriented in a first direction and a second set of interconnects oriented in a second direction, different from the first direction;

wherein the first set of interconnects generates a magnetic field having a first orientation when in use and the second set of interconnects generates a magnetic field having a second orientation when in use and wherein the first orientation and the second orientation are not parallel;

wherein the first orientation and second orientation are substantially orthogonal; and wherein the first set and the second set of interconnects each comprise a pin for carrying current from the first component to the second component and a pin for carrying current from the second component to the first component.

2. The apparatus of claim 1, wherein the second direction reduces cross-talk between the first set of interconnects and the second set of interconnects.

3. The apparatus of claim 1, wherein the first pair of interconnects generates an inductance having a first orientation when current is applied to the interconnects between the first component and the second component, wherein the second pair of interconnects generates an inductance having a second orientation when current is applied to the interconnects between the first component and the second component, the second orientation being in a direction to reduce cross-talk between the first pair of interconnects and the second pair of interconnects.

4. The apparatus of claim 3, wherein the second orientation is orthogonal to the first orientation.

5. The apparatus of claim 1, wherein the first pair of interconnects and the second pair of interconnects carry data signals when in use, the apparatus further comprising power pins between the first pair of interconnects and the second pair of interconnects for carrying a direct current between the first and device and the second device.

6. The apparatus of claim 1, wherein the interconnects comprise resilient spring connectors.

7. A socket comprising:

a receptacle to receive a microelectronic device;

a first set of pairs of interconnects to carry data between the socket and a device in the receptacle, the first set of pairs of interconnects generating an inductance having a first orientation when in use; and a second set of pairs of interconnects to carry data between the socket and the device in the receptacle, the second set of pairs of interconnects generating an inductance having a second orientation when in use, the second orientation being in a direction to reduce crosstalk between the first set of pairs and the second set of pairs;

wherein second orientation is substantially orthogonal the first orientation; and wherein each pair of interconnects comprises a pin for carrying current from the first device to the second device and a pin for carrying current from the second device to the first device.

8. The socket of claim 7, wherein each pair of interconnects comprises a pair of parallel socket pin connectors to carry differential data signals.

9. The socket of claim 7, wherein each pair of interconnects carries data signals when in use, the apparatus further comprising power pins between the pairs of interconnects to carry a direct current.

10. The socket of claim 7, wherein the interconnects comprise resilient spring connectors.

11. The socket of claim 7, wherein the first set of pairs and the second set of pairs form a pattern of pairs to reduce crosstalk.

* * * * *